United States Patent [19]

Brown

[11] 4,203,600

[45] May 20, 1980

[54] TARGET WITH REMOVABLE SCORE SHEET

[76] Inventor: Stephen D. Brown, 5765 N. Butman Rd., Rte. 4, Gladwin, Mich. 48624

[21] Appl. No.: 865,896

[22] Filed: Dec. 30, 1977

[51] Int. Cl.[2] ..... F41J 1/10; F41J 3/00

[52] U.S. Cl. ..... 273/407; 273/408; 273/409

[58] Field of Search ..... 273/102.1 R, 102 R, 273/102 PM, 102 B, 102 S

[56] References Cited

U.S. PATENT DOCUMENTS

| | | | |
|---|---|---|---|
| 1,512,819 | 10/1924 | Clark | 273/102.4 X |
| 1,935,174 | 11/1933 | Bisuillon et al. | 273/102.4 |
| 2,090,930 | 8/1937 | Chubb | 273/102.1 R |
| 2,562,089 | 7/1951 | Fishlove | 273/102 R |
| 2,726,870 | 12/1955 | Auger | 273/102 R |
| 2,812,947 | 11/1957 | Fatzinger et al. | 273/102 B |
| 3,101,198 | 8/1963 | Williams | 273/102.2 A |
| 3,128,096 | 4/1964 | Hammond et al. | 273/102.1 R |
| 3,355,174 | 11/1967 | Hutson | 273/102 S |
| 3,476,390 | 11/1969 | Roloff et al. | 273/102 R |
| 3,586,331 | 6/1971 | Tickell et al. | 273/105.2 |
| 3,729,197 | 4/1973 | Swanson et al. | 273/102 B |

FOREIGN PATENT DOCUMENTS

| | | | |
|---|---|---|---|
| 945903 | 6/1956 | Fed. Rep. of Germany | 273/102.2 R |
| 1102609 | 3/1961 | Fed. Rep. of Germany | 273/102.1 R |
| 2149919 | 4/1973 | Fed. Rep. of Germany | 273/102 S |

OTHER PUBLICATIONS

Bear Archery Catalog, (1977), Received on May 13, 1977.

*Primary Examiner*—Vance Y. Hum
*Assistant Examiner*—Lawrence E. Anderson
*Attorney, Agent, or Firm*—Basile and Weintraub

[57] ABSTRACT

A target is shaped in the form of an animate object, preferably, simulating an animal. The target is formed from any suitable material which can receive a projectile impacting thereagainst. The target is provided with a torso opening in which is emplaced a graphic representation of the internal organs of the animal so simulated. The present target is particularly adapted for use in archery.

4 Claims, 6 Drawing Figures

TARGET WITH REMOVABLE SCORE SHEET

BACKGROUND OF THE INVENTION

1. Field of the Invention

The present invention pertains to sporting equipment. More particularly, the present invention pertains to targets. Even more particularly, the present invention pertains to targets for utilization in archery, darts and similar athletic situations.

2. Prior Art

Ordinarily, most archery events comprise and contemplate the aiming of a projectile, such as an arrow, toward a target. The target is, conventionally, a "bulls-eye" target which comprises a plurality of concentric circles. Such targets are well known and commercially available to the skilled artisan.

Usually, the targets of the type under consideration herein are backed by or mounted onto some type of surface which can stop the projectile. Commonplace is the utilization of a bale of hay onto which the targets are mounted. The baled hay stops the trajectory of the arrow or similar projectile. Other backing means, are, of course, well known.

The degree of skill necessary to become an expert archer is quite high. However, most competitions utilize the type of target heretofore described. Yet, most hunting archers have little or no practice methods other than the type of target described hereinabove. To be an expert archer for the hunt requires an even greater modicum of skill. The hunting archer must be able to hit the vital organs of the animal hunted. However, and as noted, there has heretofore been a void in practice targets for such purposes.

As will subsequently be detailed, the present invention provides a new type of target which not only can be used by the competitive-type archer but by the hunting-type archer, as well.

STATEMENT OF RELEVANT ART

To the best of applicant's knowledge the following is the most pertinent art known and of which applicant is aware:

U.S. Pat. Nos. 3,101,198; 3,476,390; 1,935,174; 1,512,819; 2,562,089;

The present invention is distinct from this art in the provision of the shape of the target as well as the utilization of the graphic representation of the internal organs of the animal-form provided the target.

SUMMARY OF THE INVENTION

In accordance with the present invention, there is provided a target for utilization with projectiles such as arrows, darts, balls and the like. The target hereof comprises an inanimate form configured to the shape of a creature such as an animal or the like. A slot if formed in the torso or trunk portion of the target. Removably implaced within the slot is a graphic representation or chart depicting thereon the internal organs of the creature.

Upon a projectile impacting against the target, the point thereof penetrates the target and severs the graphic representation. In this manner, the user can determine the skill with which he has aimed and shot at the target.

In a preferred embodiment of the present invention, the target is provided with the configuration or form of a deer. The slot is formed in the back and opens internally into the interior of the trunk or torso section. The graphic representation comprises a sheet having depicted thereon the internal organs ordinarily situated in the space accorded the slot.

Furthermore, and in accordance herewith, a drain spout is connected to the slot. This enables drainage of moisture which would otherwise collect in the slot and thereby cause mildew or the like to the target.

For a more complete understanding of the present invention, reference is made to the following detailed description and accompanying drawing. In the drawing like reference characters refer to like parts throughout the several views in which:

DESCRIPTION OF THE PREFERRED EMBODIMENT

Figure 1:
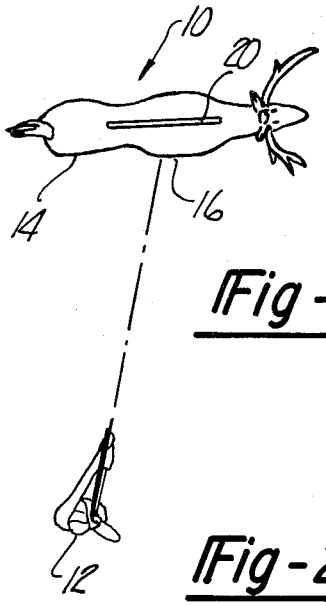
FIG. 1 is an aerial view of a target in accordance with the present invention in use.
Figure 2:
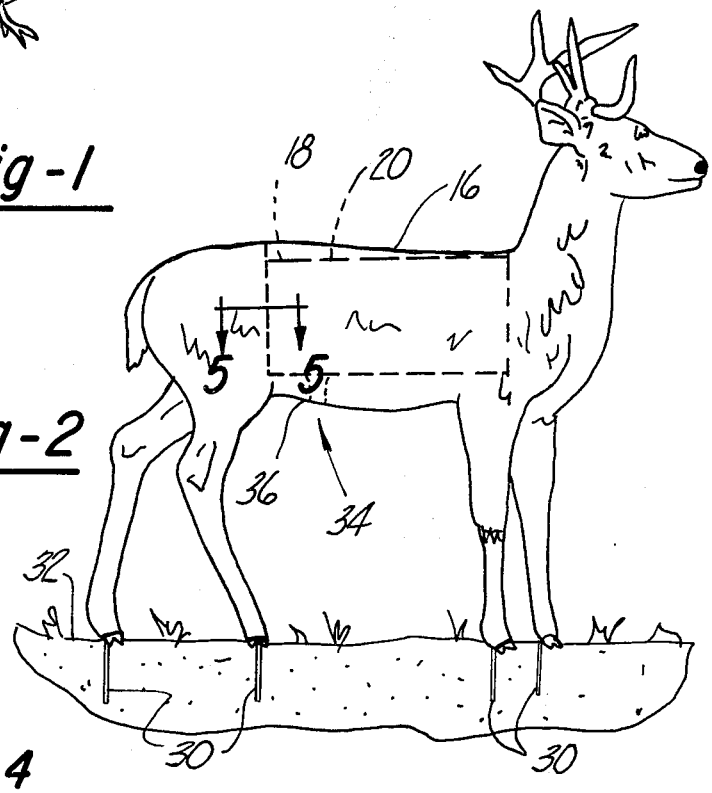
FIG. 2 is a front elevational view of a target in accordance with the present invention.
Figure 3:
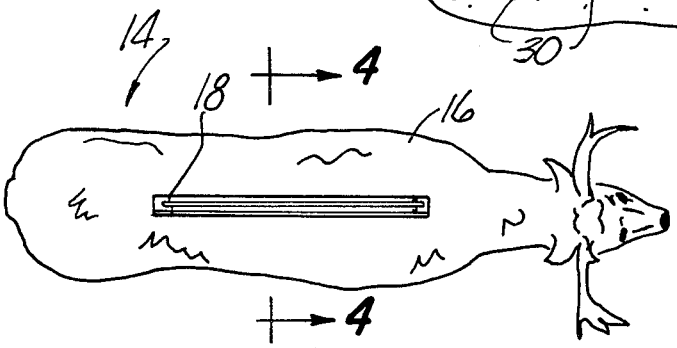
FIG. 3 is a top plan view of the target hereof.
Figure 4:
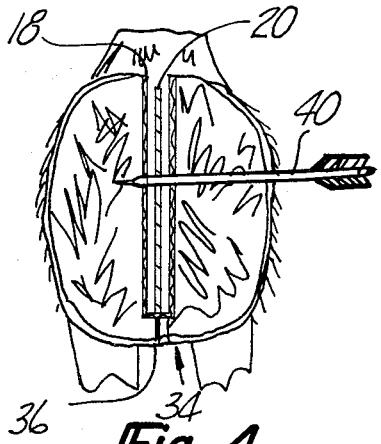
FIG. 4 is a cross-sectional view taken along line 4—4 of FIG. 3.

Now, and with reference to the drawings, there is depicted therein a target, generally denoted at 10, in accordance with the present invention. The target is adapted for use by an archer or hunter 12 who stands a distance away and then aims at the target 10, in the well known manner.

At the outset, it is to be understood that as contemplated herein the target 10 can assume any form, as desired. Thus, the animal form depicted in the drawing is to be construed as illustrative, rather than limitative of the present invention. However, and as will subsequently be detailed, in a preferred form of the present invention a deer is a most desirable configuration. Again, it is to be understood that in the practice of the present invention the target 10 comprises an inanimate form configured to any desired shape.

Referring, again, to the drawing, the target 10 comprises an inanimate form configured to the shape of an animal or similar creature 14. The target essentially comprises a main body member 16.

The main body member 16 is formed from any suitable material having a sufficient thickness and density to stop retard penetration of a projectile. Contemporaneously, the main body 16 must be formed from a material which permits penetration of the projectile. Such materials are well known to the skilled artisan. Thus, for example, the main body 16 can be formed from polystyrene, baled hay, or any other material which would meet the requisites hereof.

The main body or torso 16 is provided with a slot 18. The slot extends into the interior of the main body. The slot 16 defines means for enabling removable emplacement of a scoresheet 20.

The slot 18 has a width or diameter greater than the width of the scoresheet 20. Thus, the slot is dimensioned such that the scoresheet 20 can be removably inserted therewithin. Furthermore, the slot has a height greater than that of the scoresheet such that upon insertion thereof into the slot the scoresheet is completely hidden from the hunter or user 12.

The scoresheet 20 comprises a substantially flat planar member 22 having imprinted thereon certain indicia 24. Preferably, the indicia 24 correspond to or correlate to the internal structure of the inanimate form simulated by the main body 16.

Figure 6:
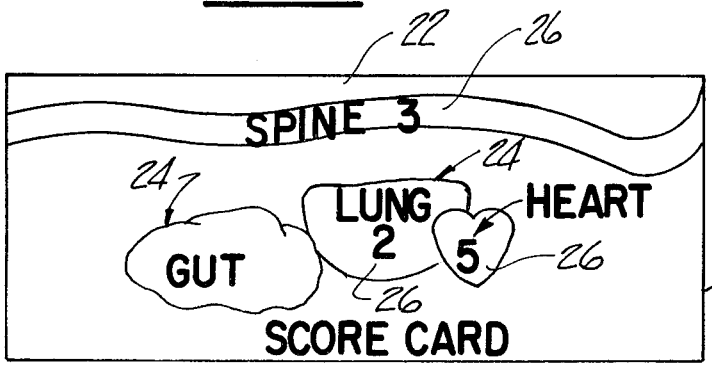
FIG. 6 is a plan view of a graphic representation as contemplated for use in the practice of the present invention.
Figure 5:
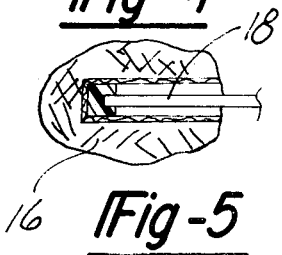
FIG. 5 is a cross-sectional view taken along line 5—5 of FIG. 2.

Thus, and with reference to the form depicted in the drawing, the indicia 24 correspond to the internal organs of the inanimate form depicted therewithin. Specifically, and as shown in FIG. 6, the indicia 24 comprise the heart, lung and intestinal area of the animal. Furthermore, the indicia are positioned or disposed on the scoresheet in substantially correct biological location and orientation.

A rating evaluation 26 is, also, provided on the scoresheet. Herein, suitable indicia which rank the degree of skill, are associated with each of the indicia 24.

The scoresheet or scorecard 20, per se, is formed from any material which can have a projectile penetrate therethrough without substantially ripping or destroying the scoresheet. Thus, any material which will retain substantially the integrity of the scoresheet can be utilized as the material therefore. Thus, a heavy paper, cardboard, or synthetic resinous material can be utilized as the material for forming the scoresheet.

In practicing the present invention the scoresheet is removably disposed within the slot by manually inserting same thereinto.

The preceeding discussion provides a discussion of the basic precepts of the invention thereof.

Referring, specifically, to the drawing, there is depicted therein a particularly preferred embodiment of the invention. As shown in FIG. 2–5 the main body 16 is provided in the form of a deer. The deer includes a trunk section, a head section, a tail and legs depending downwardly from the shoulder and the rear end. Disposed at the end of each leg at the foot section and downwardly depending therefrom is a ground stake 30. The ground stakes are used to mount the target 10 into the ground 32.

The slot 18 is formed in the back of the animal and opens into the interior thereof. The slot is a longitudinally extending member which simulates an incision into the heart, lung and intestinal area of the deer.

The embodiment of the invention depicted in the drawing is adapted to be utilized out of doors. Thus, this creates the probability of condensation collecting within the slot. Thus, and in accordance herewith, drain means, generally denoted at 34, permits drainage of the condensation from the slot. To this end, the base of the slot is formed at an incline with respect to the ground surface. This enables any condensation to drain down the slot of the incline. The drain means comprises a tubular opening 36 which extends between the slot and the environment or atmosphere.

In accordance herewith, the scoresheet 20 comprises a graphic representation of the internal organs of the deer and their substantially proper biological positioning and orientation correlating to the area cut out by the slot. Thus, and as shown in the drawing, the slot position correlates to the heart, lung and intestinal area of the deer. The target thus has a graphic representation of the lung, heart and intestinal area of the deer imprinted on the scoresheet. Certain numerical evaluations are accorded each of these organs.

When using the present invention, the scoresheet is removably replaced within the slot. The user than takes aim at the target. Assuming an arrow 40 to be the projectile, and the user an archer, the archer then shoots the arrow at the target, attempting to hit the scoresheet. The point of the arrow penetrates the main body as well as the scoresheet. Again, the materials of construction of the main body limit the degree of penetration of the projectile. After the archer has shot his arrows at the target, the scoresheet is removed therefrom and the scoring is evaluated. Thereafter, a new scoresheet can then be inserted into the slot.

Because of the material of construction of the main body, per se, this may be consumed and need be replaced periodically. However, such does not detract from the efficacy of the present invention.

It is to be appreciated from the preceeding that there has been described herein a new target for utilization by archers, dart throwers, or similar type competitors. The structure hereof enables the scoresheet to be hidden from the user thereby honing the skills of the user.

It is apparent that many modifications and departures can be made in the practice of the present invention without departing from the spirit and scope hereof. Such alterations and modifications are within the ambit and purview of the present invention.

Having, thus, described the invention what is claimed is:

1. A target comprising:

(a) a flat, planar score sheet with indicia imprinted thereon having substantially the same configuration and position as the internal organs of an animate object;

(b) a main body simulating the form of an animate object, said body having a construction which reduces the speed of a projectile impacting thereagainst or penetrating there into;

(c) the main body having a normally open vertical slot, said slot having a rectangular cross section in the horizontal plane defining means for removably receiving and retaining said score sheet, said slot being dimensioned greater than the score sheet and extending between portions of the main body such that emplacement of the score sheet within the slot substantially hides the score sheet from the view of the user;

(d) means within said slot for draining the slot; said main body being constructed from material of such thickness and density that a projectile penetrating the main body will traverse the slot and the score sheet emplaced there within.

2. The target of claim 1 wherein:

the base of the slot is angularly inclined with respect to a ground surface.

3. The target of claim 1 which further comprises:

means for staking the main body in the ground.

4. The target of claim 1 wherein:

the target is in the form of a deer.

* * * * *